US006644328B1

(12) United States Patent
Lenhart

(10) Patent No.: US 6,644,328 B1
(45) Date of Patent: Nov. 11, 2003

(54) STICK SIMILAR TO A SKI STICK OR WALKING STICK

(76) Inventor: Klaus Lenhart, Mittlerer Weg 23, 73275 Ohmden (DE)

( * ) Notice: Subject to any disclaimer, the term of this patent is extended or adjusted under 35 U.S.C. 154(b) by 0 days.

(21) Appl. No.: 09/807,977

(22) PCT Filed: Nov. 15, 1999

(86) PCT No.: PCT/EP99/08773

§ 371 (c)(1),
(2), (4) Date: Apr. 30, 2001

(87) PCT Pub. No.: WO00/29079

PCT Pub. Date: May 25, 2000

(30) Foreign Application Priority Data

| | | |
|---|---|---|
| Nov. 18, 1998 | (DE) | 298 20 452 U |
| Jul. 31, 1999 | (DE) | 299 13 403 U |
| Nov. 9, 1999 | (DE) | 299 19 631 U |

(51) Int. Cl.[7] ..... A45B 3/00; A45B 5/00

(52) U.S. Cl. ..... 135/66; 52/65; 52/67; 52/72; 52/76; 16/111.1; 16/421; 16/422; 280/819; 280/821; 403/59; 403/144; 403/166

(58) Field of Search ..... 135/65, 72, 75, 135/76, 66, 67, 74, 911; 280/821, 823, 819; 403/52, 53, 57, 59, 119, 144, 166; 16/111.1, 421, 422; D18/DIG. 6

(56) References Cited

U.S. PATENT DOCUMENTS

| | | | | |
|---|---|---|---|---|
| 4,597,589 A | | 7/1986 | Fujii et al. | |
| 5,287,870 A | | 2/1994 | Rhodes | |
| 6,070,907 A | * | 6/2000 | Bujold et al. | 280/821 |
| 6,082,767 A | * | 7/2000 | Bujold et al. | 280/819 |
| 6,142,527 A | * | 11/2000 | Lenhart | 280/823 |
| 6,203,063 B1 | * | 3/2001 | Bujold et al. | 280/819 |

FOREIGN PATENT DOCUMENTS

| | | | |
|---|---|---|---|
| DE | 504878 | | 7/1930 |
| DE | G8702756.9 | | 4/1987 |
| DE | 4440343 A1 | | 5/1996 |
| DE | 19642297 A1 | | 5/1998 |
| DE | 19642297 C2 | | 8/1998 |
| EP | 0149576 | * | 1/1985 |

* cited by examiner

*Primary Examiner*—Carl D. Friedman
*Assistant Examiner*—Yvonne M. Horton
(74) *Attorney, Agent, or Firm*—Jones, Tullar & Cooper, P.C.

(57) ABSTRACT

A stick such as a ski-stick, walking stick or same, provided with a handle comprising a gripping element and a length-adjustable pole in addition to a regulating device that contains a joint and is arranged outside the pole, whereby the gripping element can be positioned at an angle to the pole and a tubular part of the pole can be pushed through the joint into the gripping element of the pole when the regulating device is oriented in a rectilinear position. This ensures that the regulating device is substantially protected against the effects of the environment and the diameter of the pole is increased to a lesser degree. In order to achieve this, a regulating element is respectively formed by the handle on a lower extension piece of the gripping element and a cap that is firmly connected to the upper end of the pole, whereby one respective regulating element is pivotally and moveably accommodated in a recess of the other regulating element.

24 Claims, 12 Drawing Sheets

FIG. 5(A)
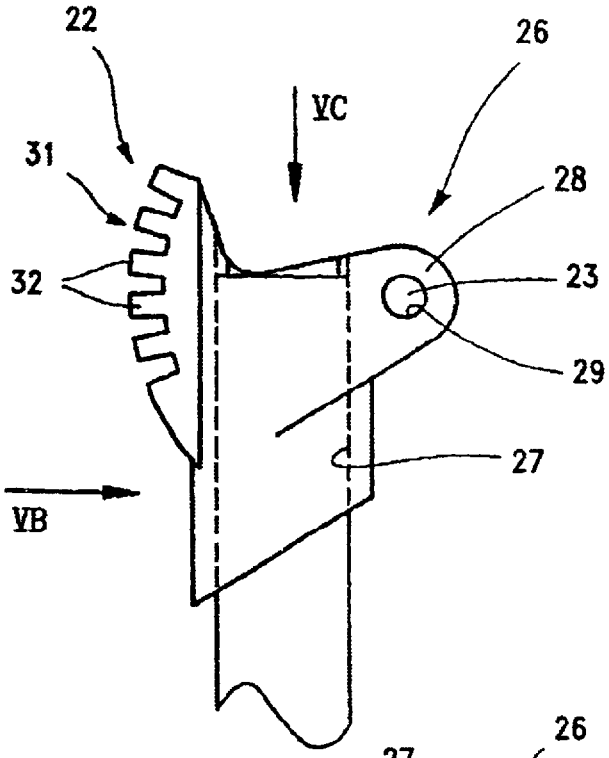
FIG. 5(B)
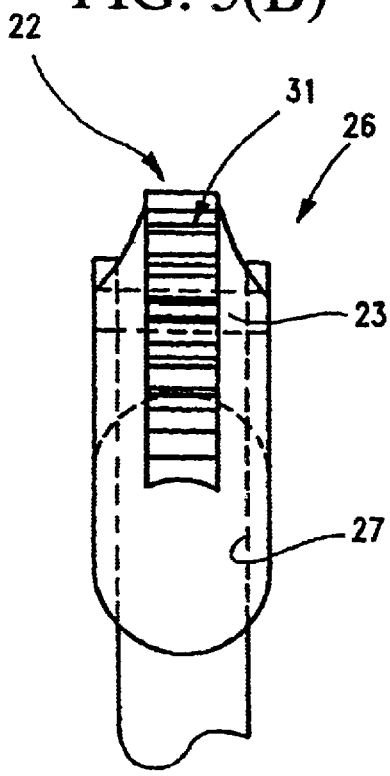
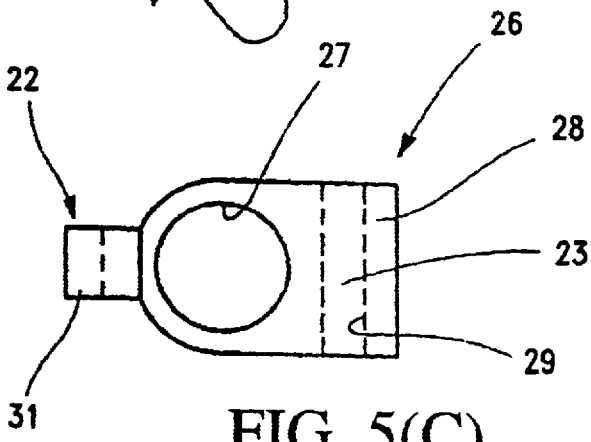
FIG. 5(C)

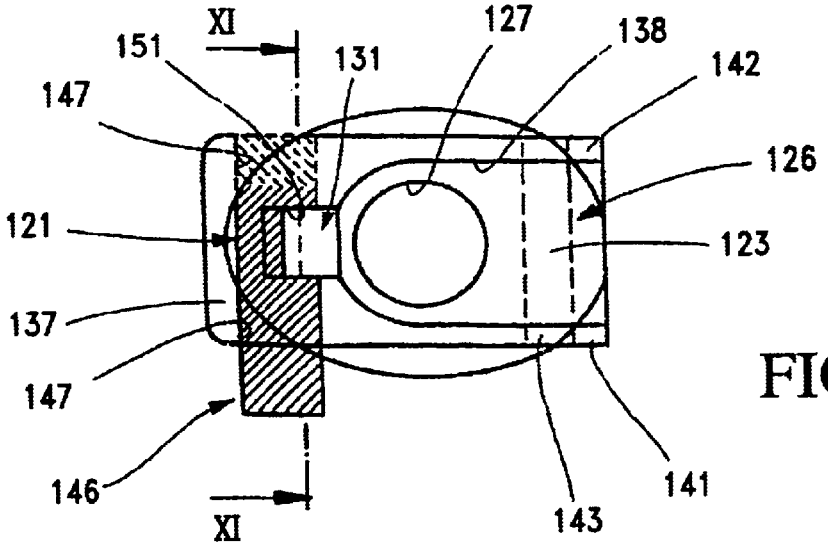
FIG. 8
FIG. 9
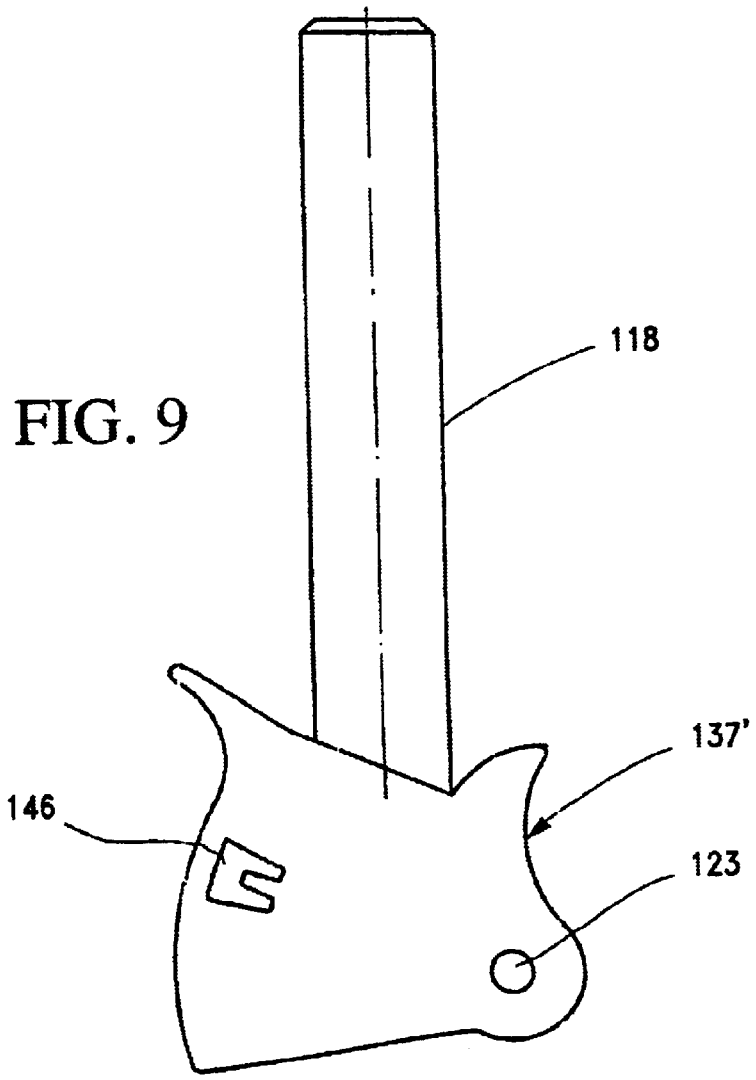

FIG. 10(A)
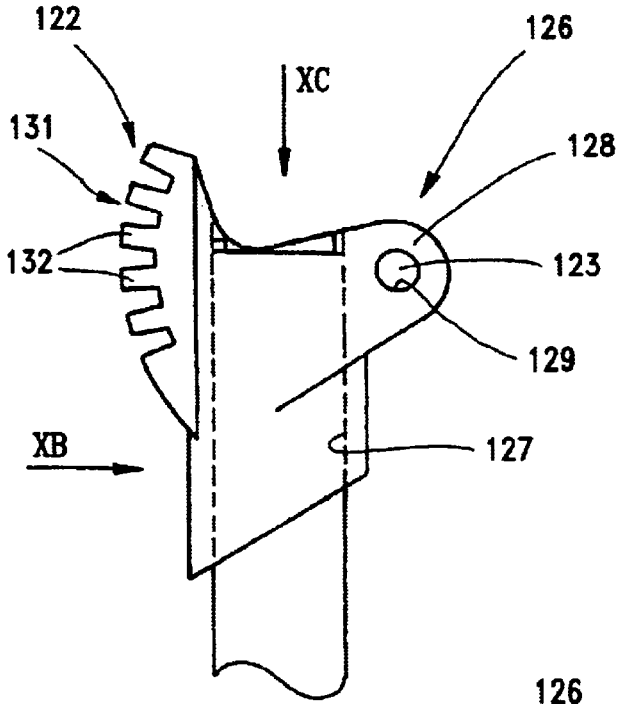
FIG. 10(B)
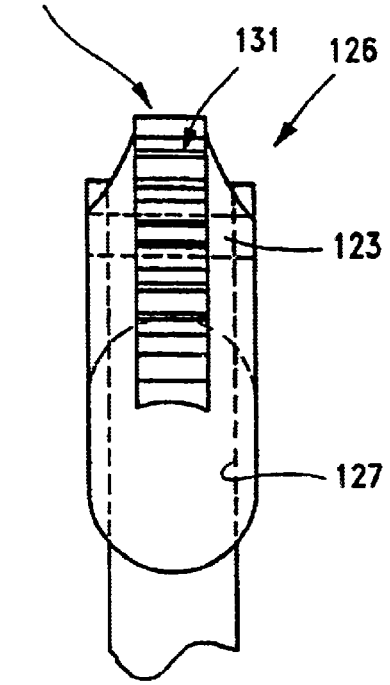
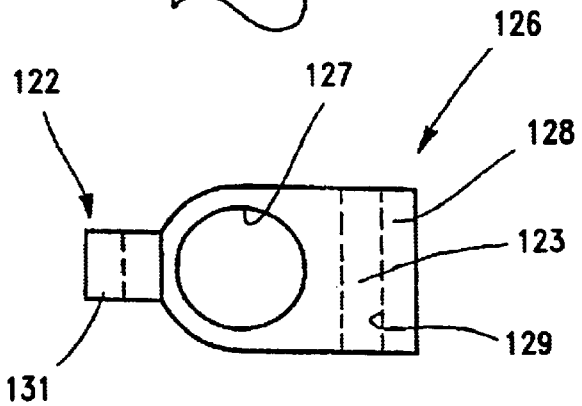
FIG. 10(C)
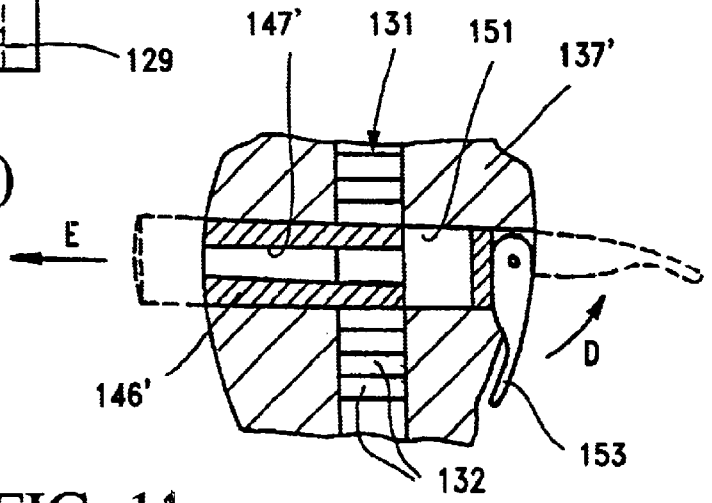
FIG. 11

STICK SIMILAR TO A SKI STICK OR WALKING STICK

FIELD OF THE INVENTION

The present invention relates to a stick, such as a ski pole, walking stick, or the like, with a stick handle having a handle element and a stick tube, as well as an adjusting device, which contains a hinge and is arranged outside of the stick tube, by means of which the handle element of the stick handle can be fixed in place in an angled position with respect to the stick tube. The stick tube has a straight orientation including a tube element which can be pushed through the hinge into the handle element of the stick handle.

BACKGROUND OF THE INVENTION

With such a stick, known from German Patent DE 196 42 297 C2, which can be shortened to a short size for packing, the adjusting elements of the adjusting device are formed by an extension element of a stick tube element maintained in the stick handle and by a fork-like receiver element maintained on the stick tube. The fork-like receiver element is held, fixed in the various angled positions, on laterally projecting pins of the extension element by means of screw caps. The adjusting device is arranged exposed on the stick tube of this construction, which can lead to problems in the winter in case of ice and snow. Moreover, the adjusting elements of the adjusting device considerably project past the diameter of the stick tube.

SUMMARY OF THE INVENTION

It is therefore the object of the present invention to provide a stick of the type mentioned at the outset, whose adjusting device is protected to a large extent against environmental influences and extends less with respect to the diameter of the stick tube.

To achieve this object the stick handle forms an outer adjusting element and a cap on the lower extension element of the handle element, the cap being fixedly connected with the upper end of the stick tube. The outer adjusting element and the cap constitute an adjusting element of the adjusting device, wherein the one adjusting element is pivotably received in a cutout of the other adjusting element.

It is achieved by means of the measures in accordance with the present invention that the adjusting device is arranged to be covered inside the stick handle, so that it is generally protected from external influences, such as ice and snow. Because of the arrangement inside the stick handle, the actual, and in particular the visual, widening of the stick tube is essentially reduced.

In accordance with one embodiment, a less protruding housing of the pivot hinge and locking device is achieved in that the two adjusting elements have the pivot shaft on one side of the stick tube, and on the opposite side of the stick tube a locking device for fixation of the respective angled position. It is useful here to design the locking device in that the locking device has an outer tooth arrangement at the adjusting element of the cap of the stick tube, and a locking slide on the extension element of the stick handle. In order to prevent in this case an unintended actuation of the locking slide in the opening direction, locking slide projects past one side of the stick handle are provided.

Further advantageous embodiments of this locking device ensue from a locking slide having a longitudinal groove which receives the respective tooth of the outer tooth arrangement, and a notch which releases the tooth, from embodying the locking slide conically with an eccentric lever assigned to the locking slide, and from receiving the cap inside the cutout of the lower extension element for every angled position of the outer tooth arrangement.

Two adjusting elements on one side of the stick tube have a pivot hinge, with an eccentric lever cooperating with the pivot hinge for clamping fixation in place of the two adjusting elements in the respective position represent another embodiment of the locking device. Besides a less protruding placement of the pivot hinge and the locking device, a quick and easy to handle fixation of the angle position setting furthermore results. In this connection it is useful to design the eccentric lever by maintaining the pivot shaft of the pivot hinge on one, preferably outer, adjusting element and the eccentric lever on the other, preferably inner, adjusting element and/or by seating the pivot shaft in a bore which has a greater diameter and is eccentric with respect to it, of the eccentric lever.

An adjusting device which can be fixed over a large surface is created in that the one adjusting element has an interior surface in the shape of a universal ball joint, and the other adjusting element has a corresponding exterior surface in the shape of a universal ball joint. In order to achieve a sufficient fixation, or clamping, by means of the eccentric lever here, either the interior surface and the exterior surface are provided with a friction coating, or the interior surface and the exterior surface are provided with profiling are provided. Because of this, a frictional fixation results in the one case, while in the other case an interlocking fixation has been achieved.

By means of providing the adjusting device with a device to indicate the adjusted position, it is possible in a simple manner to set both sticks of a pair of sticks at the same angle and to fix them in place in the same way. In this case a visually attractive and easy-to-read indication can be embodied having a window on the outer adjustment element and a marking on the inner adjusting element and/or the window is constituted by a plurality of window sections, which are arranged along a ring section of a circle and whose shape corresponds to that of the marking.

Further embodiments ensue from the provision of an axial blind bore in the stick handle, which lengthens the stick tube, and/or forming the handle element with a lower extension element.

In a further exemplary embodiment wherein the handle element of the stick handle is maintained on a handle tube element into which, in a straight orientation of the stick, the tube element of the stick tube can be pushed through the hinge, the handle element of the stick handle is embodied in two pieces by an upper partial handle element and a separate lower partial handle element, and that the upper partial handle element can be placed on the handle tube element and fastened the advantage results that sticks, embodied in this way, are uniformly pre-produced and preassembled, except for the upper handle element, until at the end of this preassembly the upper handle element suitable for the desired type of handle must yet be attached. In this case the upper handle elements can differ in form and/or technology.

The selection of the upper handle elements can be exclusively limited to those at the final assembly, however, it can also take place later in that the upper partial handle element of the handle element of the stick handle is maintained removably for exchange.

In this connection the upper partial handle element contains all or parts of the handle area, and/or, on its ends adjoining the lower partial handle element, the partial handle element is provided with a shape which makes a transition into the shape of the respective end of the lower partial handle element are usefully provided in order to achieve, on the one hand, a more or less extensive changed portion in the handle area and, on the other hand, to obtain a tactile and visual transition from the handle element to the extension element.

Further embodiments ensue from the lower partial handle element having a cutout which partially receives the outer tooth arrangement of the adjusting element, and/or the handle element and the partial handle element are extruded as one piece.

BRIEF DESCRIPTION OF THE DRAWINGS

Further details of the present invention can be taken from the following description, in which the present invention is described in greater detail and explained by means of the exemplary embodiments represented in the drawings. Shown are:

FIGS. 5A to C, show the upper end of the stick tube in FIG. 1 in a lateral view, front view in accordance with the arrow VB, or in a view from above in accordance with the arrow VC in FIG. 5A, FIGS. 6A and 6B, show lateral views of a stick angled in the handle area in accordance with a second exemplary embodiment of the present invention in an angled, or in a straight position, FIG. 8, is a section along the line VIII—VIII in FIG. 6A, FIG. 9, shows the stick handle in FIG. 7 without the handle element in a lateral view, FIGS. 10A–C, show the upper end of the stick tube in a lateral view, front view in accordance with the arrow XB, or in a top view in accordance with the arrow XC in FIG. 10A, FIG. 11, is a section along the line XI—XI of FIG. 8, but in accordance with a variation.

DETAILED DESCRIPTION

Figure 1:
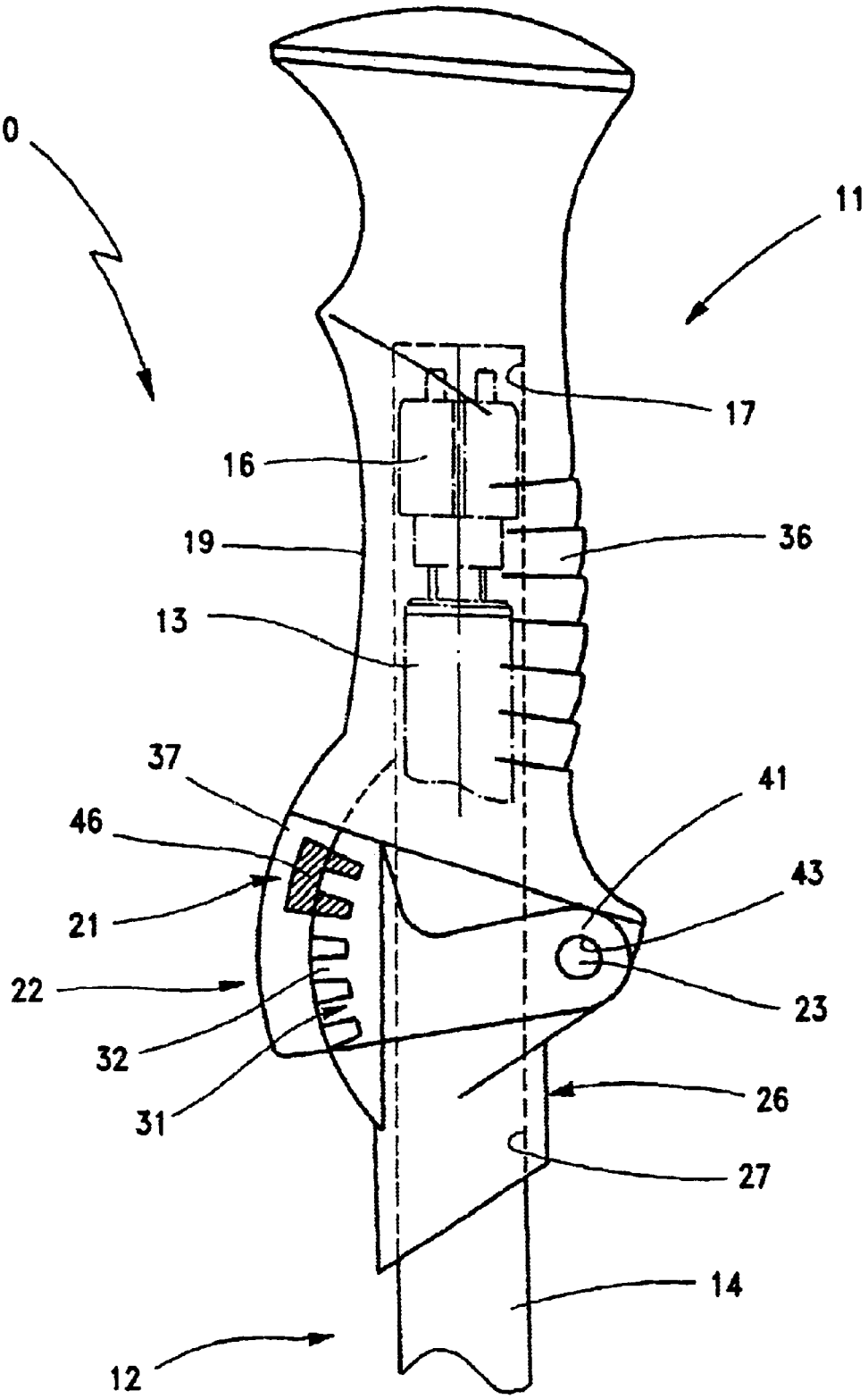
FIG. 1, is a lateral view of a stick angled in the stick handle area in accordance with a first exemplary embodiment of the present invention.
Figure 2:
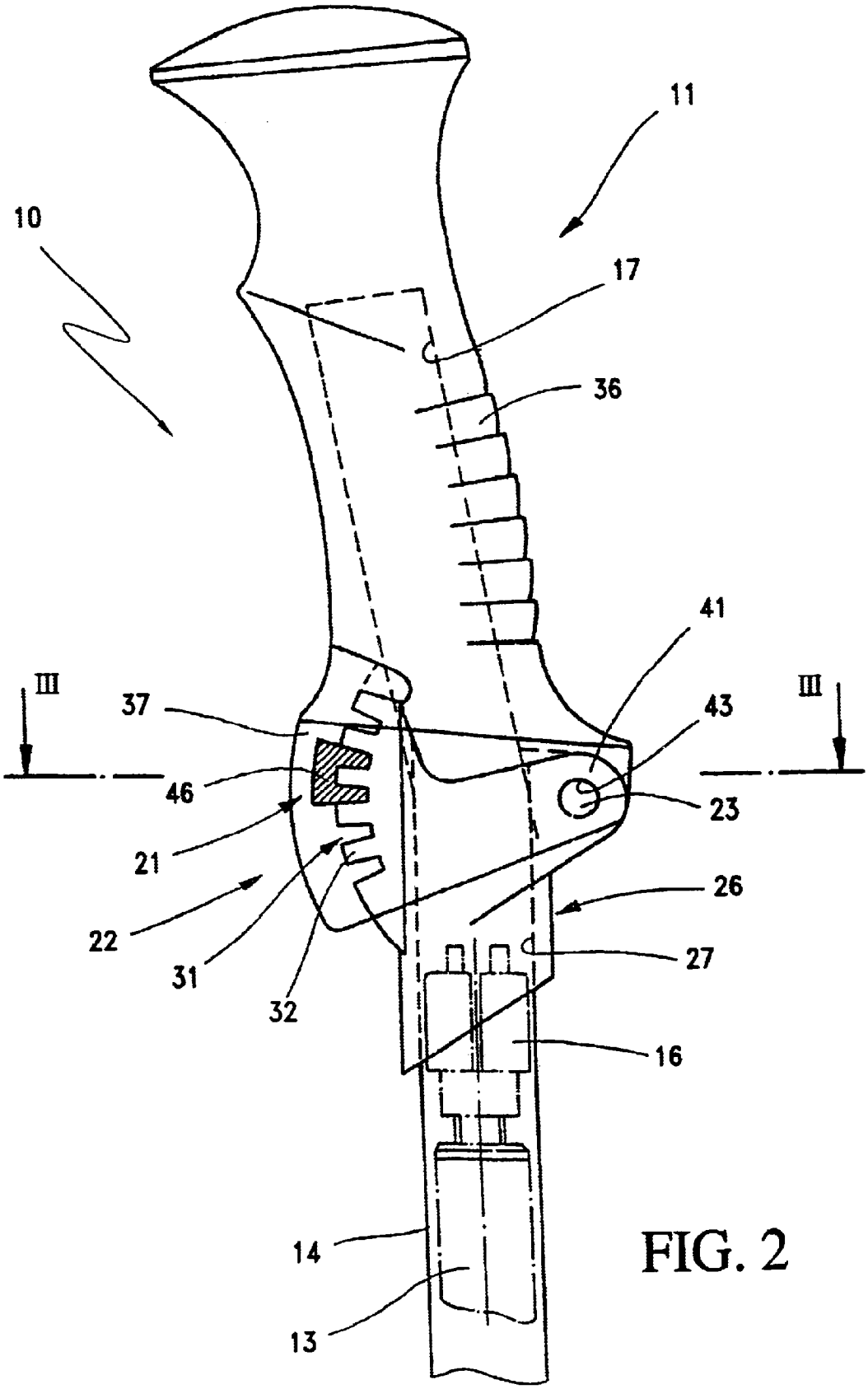
FIG. 2, is a representation corresponding to FIG. 1, but with a handle angled with respect to the stick tube.

The stick 10, 110, or 210, shown by way of example in the drawings in accordance with several embodiments, for example in the form of a ski pole, has a stick handle 11, 111 or 211, and a stick tube 12, 112, or 212, for example made of metal. The length of the stick tube 12, 112, 212 can be telescopically changed in that a lower inner tube 13, 113, 213 with a disk, not represented, can be pushed into an upper outer tube 14, 114, 214. The inner tube 13, 113, 213 has a spreading element 16, 116 (not represented in the second exemplary embodiment) so that in the course of twisting the inner tube 13, 113, 213 with respect to the outer tube 14, 114, 214 these two can be fixed against each other and in the circumferential direction in the axial direction by means of the spreading element 16, 116, 216. In an extension of the outer tube 14, the stick handle 11 has a blind bore 17, 217, or receives a stick tube element 118, whose interior diameter is equal to that of the outer tube, so that the inner tube 13, with its spreading element 16 leading, can be pushed into the blind bore 17, or into the stick tube element 118 and can be fixed in place there in the above manner, when the stick handle 11, 111, 211 and the stick tube 12, 112, 212 are aligned straight with respect to each other (FIGS. 1, or 10B). In this way it is possible to bring the telescoping stick 10, 110, 210 down to a short size for packing. It goes without saying that, in place of the two tube elements 13, 113, 213 and 14, 114, 214, the telescoping stick can also have three or more tube elements, which can be telescopically pushed into each other.

The stick 10, 110, 210 is designed in such a way that the stick handle 11, 111, 211 is angled with respect to the stick tube 12, 112, 212 and can be fixed in various angled positions. For this purpose the stick 10, 110, 210 has an adjusting device 22, pivot shaft 23, 123, 223 and a locking device 21, 121, 221 in a covering area between the end of the stick handle 11, 111, 211 and the upper end of the outer tube 14, 114, 214 of the stick tube 12, 112, 212.

In the first and second embodiments in accordance with FIGS. 5 or 10, the upper end area of the outer tube 14, 114 of the stick tube 12, 112 is connected, fixed against relative rotation and displacement, with an inner adjusting element or cap 26, 126. The cap 26, 126, which is a part of the adjusting device 22, 122, has a through-bore 27, 127, in which the outer tube 14, 114 is fixedly received. The cap 26, 126, which is preferably made as a single piece from plastic, has a radially projecting eye 28, 128 with a bore 29, 129 for receiving the pivot shaft 123 on one circumferential side, and a toothed ring section 31, 131 on the diametrically opposite circumferential side. The width of the eye 28, 128 approximately corresponds to the exterior diameter of the cap 26, 126. On the circumference, the toothed ring section 31, 131 is embodied as a narrow arc of a circle around the center axis of the bore 29, 129 of the eye 28, 128. The toothed ring section 31, 131 is provided with several, here five, teeth 32, 132 on this circumference, and the tooth ring section 31, 131 extends symmetrically downward, or upward, in relation to a horizontal line drawn through the bore 29, 129.

Figure 3:
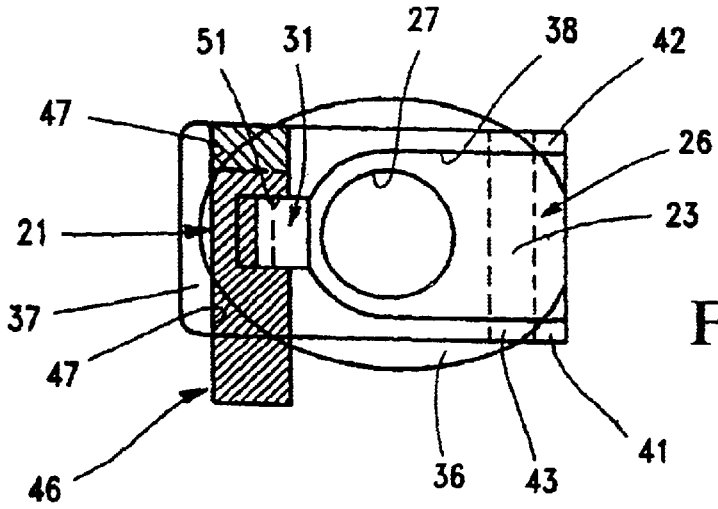
FIG. 3, is a section along the line III—III in FIG. 2, FIG. 4, shows the handle of the stick in FIG. 1 in a lateral view.

The stick handle 11 in accordance with the first exemplary embodiment (FIGS. 1 to 5), which is designed to fit the hand ergonomically, has an outer adjusting element, or extension element 37, which is designed approximately rectangularly, as seen in FIG. 3, on its lower end adjoining the grip area 36, which is approximately oval in cross section. The element 37 of the stick handle 11, which also constitutes a part of the adjusting device 22, has a cutout 38, in which the upper area of the cap 26 with the eye 28 and the toothed ring section 31 are received. For this purpose the cutout 38 has a section on both sides of the blind bore 17 which corresponds to the shape of the eye 28, or of the toothed ring section 31. The section of the cutout 38 receiving the eye 28 of the cap 26 is delimited by two cheeks 41, 42, arranged in the shape of a fork, which are provided with a bore 43, which bores 43 are aligned with the bore 29 of the eye 28 and through which the pivot shaft 23 passes in the assembled state.

In accordance with the second exemplary embodiment (FIGS. 6 to 11), the stick handle 111 essentially consists of the stick tube element 118 and the handle element 119, which is ergonomically designed to fit the hand. The handle element 119 is composed of an upper handle element 134, which is approximately oval in cross section, and a lower handle element 137 which, in cross section, can be embodied to be approximately rectangular, as can be seen in FIG. 8. The lower handle element, or outer adjusting element, or extension, or partial handle element 137 of the stick handle 111, which also forms a part of the adjusting device 122, has a cutout 138, in which, on the one side, an end of the handle tube element 118 is received, or mounted, fixed in place and, on the other side, the upper area of the cap 126 with the eye 128 and the toothed ring section 131 is movably received. On both sides of its through-bore 127, which receives the handle tube element 118 in its end, the cutout 138 has a section, or a shaped part, which corresponds to the shape of the eye 128, or the toothed ring section 131. The shaped part of the cutout 138 receiving the eye 128 of the cap 126 is delimited by two cheeks 141, 142, arranged in a fork-like manner, which are provided with a bore 143, which bores 143 are aligned with the bore 129 of the eye 128 and through which the pivot shaft 123 passes in the assembled state.

Figure 7:
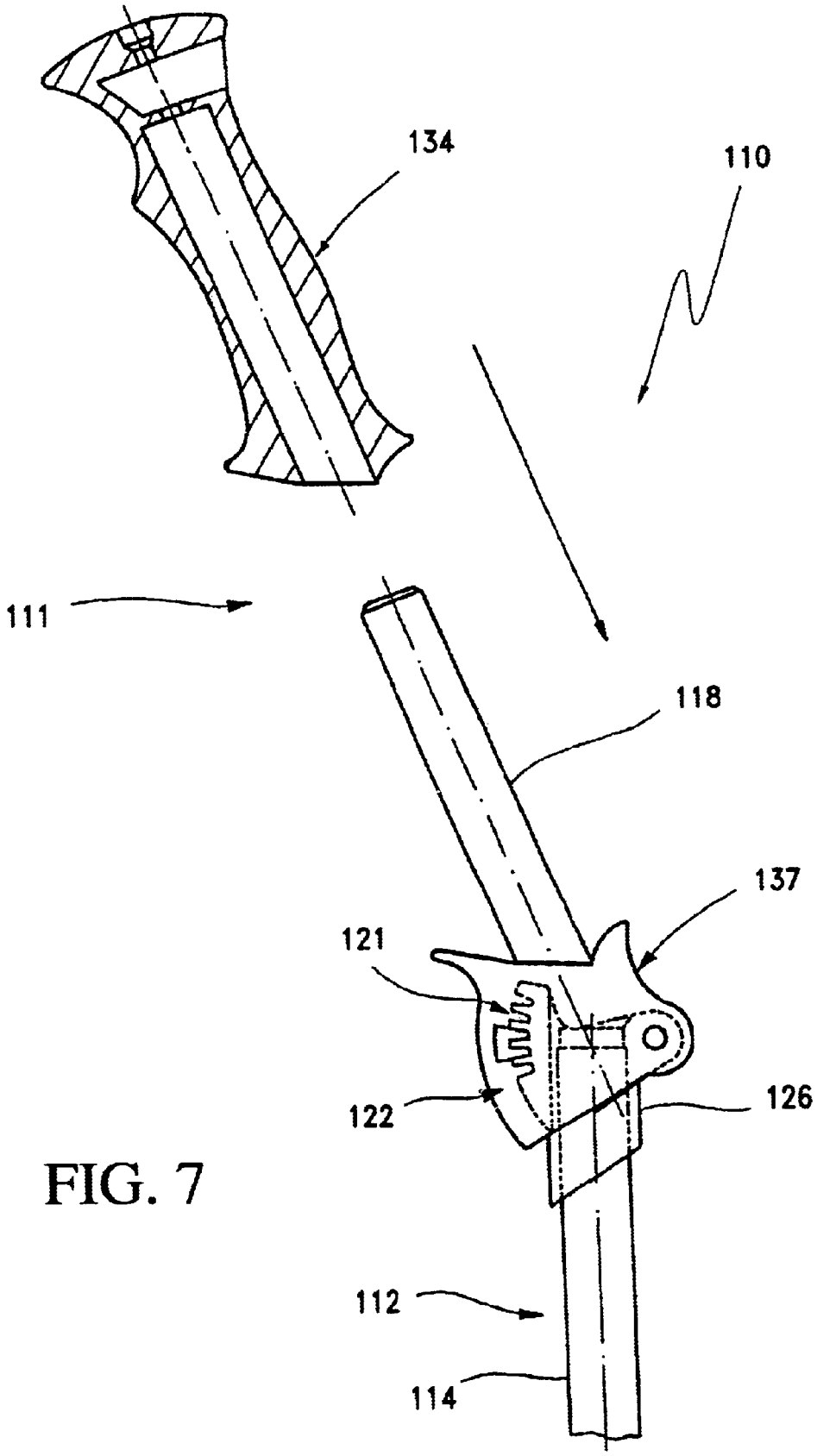
FIG. 7, is a representation corresponding to FIG. 6A, but prior to the application of the handle element on the handle tube portion of the stick handle.
Figure 12:
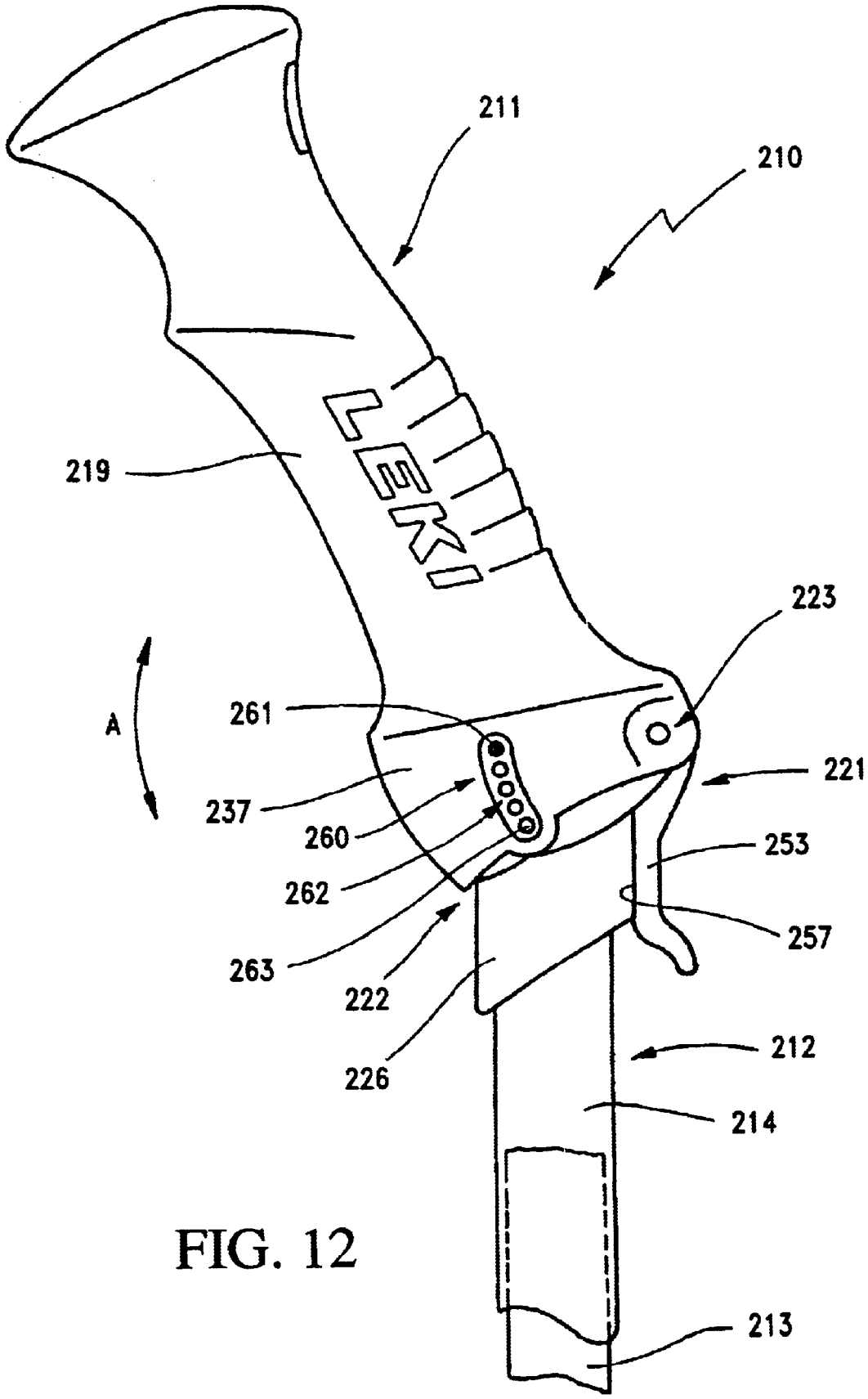
FIG. 12, is a schematic lateral view of a stick in accordance with a third exemplary embodiment of the invention, which can be or is angled off in the area of the stick handle.

As can be seen in FIG. 7, the adjusting device 122, including the locking device 121, is provided on the one side on the cap 126, and on the other side on the lower handle element 137, which is separated from the upper handle element 134. Following the assembly of the outer stick tube 114 with the cap 126 and the handle tube element 118, the upper handle element 134 with the lower handle element 137 can be placed on the handle tube element 118. It is possible because of this to employ handle elements 119 of different shapes and structural design, independently of the production and assembly process of the adjusting device 122 with the locking device 121 on the telescoping stick 110. For example, the handle elements 119 can differ in size, as well as in surface structure, as well as in the fastening of their wrist strap. In its area adjoining the upper handle element 134, the lower handle element 137 is shaped in such a way that a transition area is formed, which is advantageous, or attractive, with respect to handling and visual appearance.

In the first and second exemplary embodiments, a locking slide 46, 146 which, the same as the toothed ring section 31, 131, is a part of the locking device 21, 121, can be moved transversely in the groove-like section of the cutout 38, 138, which is located diagonally opposite the cheeks 41,42, or 141, 142, and receives the toothed ring 31, 131. The locking slide 46, 146 is approximately U-shaped in cross section and is guided parallel with the pivot shaft 23, 123 in corresponding U-shaped grooves 47, 147 of the extension 37, 137 of the stick handle 11, 111. The locking slide 46, 146 penetrates the groove-like section of the cutout 38, 138, which separates the two U-shaped grooves 47, 147 from each other in a guided manner, and projects past a side of the stick handle extension 37, 137.

The locking slide 46, 146, whose base leg 48, 148 is designed in a dovetailed manner and is guided in the stick handle extension 37, 137, has a notch 51, 151 in the area of its lateral legs 49 and 50, or 149 and 150, which is asymmetrically arranged with respect to the length of the slide and is slightly wider than the toothed ring section. This means that the locking slide 46, 146 can be brought into a release position and into a locking position by axial displacement. In the release position, the toothed ring section 31, 131 is located inside the notch 51, 151, so that the stick handle 11, 111 can be angularly inclined, or displaced, with respect to the stick tube 12, 112 in accordance with FIG. 2. In each position, which can be changed in steps, the locking slide 46, 146 can be displaced in such a way that the respective tooth 32, 132 of the toothed ring section 31, 131 comes between the lateral legs 49, 50, 149, 150 of the locking slide 46, 146, so that the respective angled position is locked in. In each locking position, the end face of the locking slide 46, 146 which must be employed for unlocking is flush with the exterior surface of the stick handle extension 37, 137, so that unintentional unlocking, or release, is not possible.

In the variation of the second exemplary embodiment represented in FIG. 11, the groove 147' of the locking slide 146' is embodied slightly conically in the direction of the locking movement in order to receive the respective tooth 132 of the toothed ring section 131 clampingly and free of play. Here, the teeth 132 of the outer tooth arrangement 131 are not conical in the direction of their width. As can be seen, the groove 147' starts at one end of the notch 151 and extends as far as the facing end of the locking slide 146. An eccentric lever 153, which is used for clamping the respective tooth 132 of the outer tooth arrangement 131, is hinged on the locking slide 146' at a place adjoining the other side of the notch 151. The opening movement takes place in that in accordance with FIG. 11 the eccentric lever 153 drawn in solid lines is pivoted in the direction of the arrow D into the position represented by dash-dotted lines. It is then possible to displace the locking slide 146 in the direction of the arrow E with the aid of the eccentric lever 153, so that the respective end of the locking slide projects out of the stick handle 111 or the partial handle element 137. Following the angular displacement, the locking slide 146' is pushed back in the direction opposite the arrow E by pressure on the projecting end, after which the eccentric lever 153 is pivoted in the direction opposite the arrow D for clamped locking.

It goes without saying that the angled inclination of the stick handle 11, 111 with respect to the stick tube 12, 112 can only take place if the inner tube 13, 113 has been pulled out of the handle tube element 18, 118 of the stick handle 11, 111. In accordance with the represented exemplary embodiment, the non-angled position of the stick handle 11, 111 with respect to the stick tube 12, 112 is the one end position of the adjusting device 22, 122, so that angling takes place in one direction exclusively. In the exemplary embodiment represented, the cutout 38, 138 in the lower partial stick handle element 137' is so deep that in the straight end position all teeth 32, 132, or their gaps of the toothed ring section 31, 131, are received inside the cutout 38, 138 and are therefore arranged covered in the lower partial stick handle element 137'.

It goes without saying that in a manner not represented the handle tube element 18, 118 is provided with an elongated cutout in an area of the circumference facing the toothed ring section 31, 131 for receiving the toothed ring section 31, 131 in one of the angled positions.

In the second exemplary embodiment the handle tube element 118 is mounted as a separate component in the lower partial handle element 137'. But in accordance with a variation, the handle tube element 118 is extruded in one piece on the lower partial handle element 137'.

In the second exemplary embodiment, the handle grip area or upper handle element 134 is constituted exclusively by the circumference of the upper partial element 134' of the handle element 119. In accordance with a further exemplary embodiment, not represented, the lower partial handle element 137' is included in this handle grip area 134, which means that the area of the hand of a user facing away from the thumb and index finger grips around an area of the lower partial handle element 137' when the hand is placed on the stick handle 111.

Figure 13:
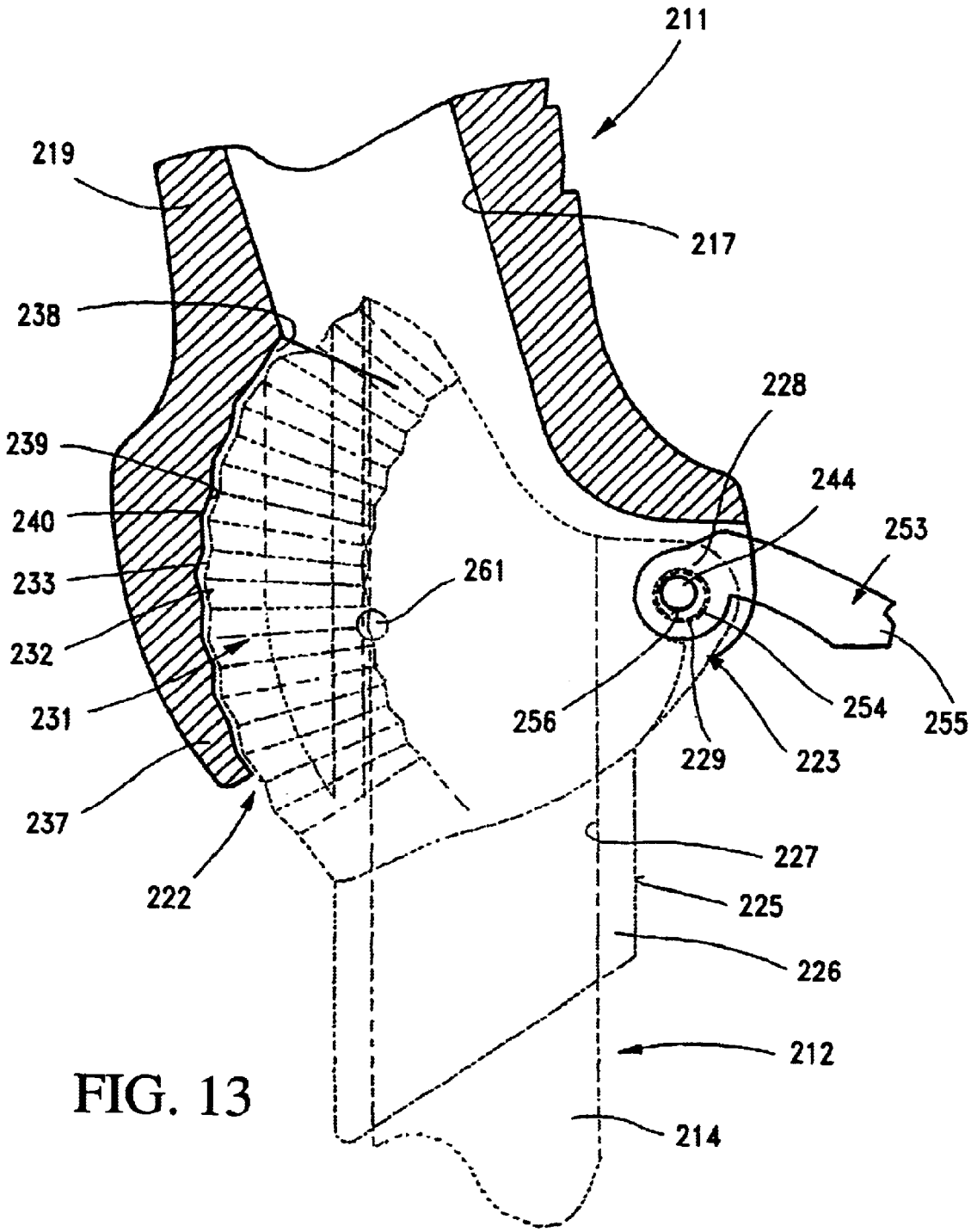
FIG. 13, shows the angled-off stick of FIG. 12 in an enlarged, broken representation of the area of the adjusting device, partially in longitudinal section and partially in a plan view.

In the third exemplary embodiment (FIGS. 12 to 15), in accordance with FIG. 13 the upper end area of the outer tube 214 of the stick tube 212 is connected fixed against relative rotation and displacement with a cap 226. The cap 226, which is a part of the adjusting device 222, has a through-bore 227, in which the outer tube 214 is fixedly received. The cap 226, which is preferably made in.one piece of plastic, has a radially projecting eye 228 with a bore 229 for receiving a shaft 254 of a clamping lever 253 on one circumferential side. The eye 228 is designed in the shape of a fork, so that a portion of the shaft 254 of the clamping lever 253 is pivotably seated at both sides, and the arm 255 of the clamping lever 253 can be pivotably moved up or down in the slit of the fork.

Diametrically opposite the clamping lever receiver 228, the cap 226 has an inner clamping section 231, which has an exterior face 233 in the shape of a universal balljoint. In the example represented, the exterior face 233 in the shape of a universal ball joint is provided with profiling, preferably ribbing 232, extending transversely to the pivot direction in accordance with the arrow A. The center of the exterior face 233 in the shape of a universal ball joint is represented by the pivot shaft 254, or its longitudinal center.

Figure 4:
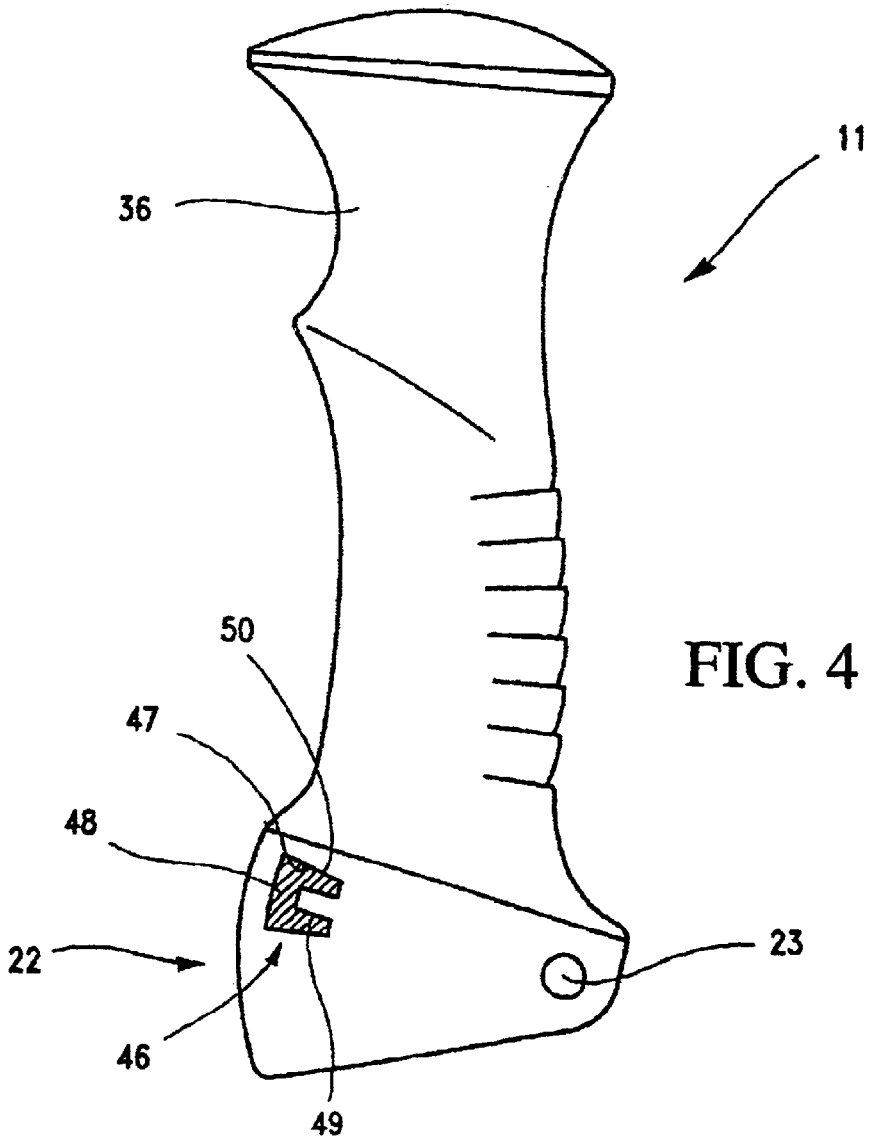
Figure 6A:
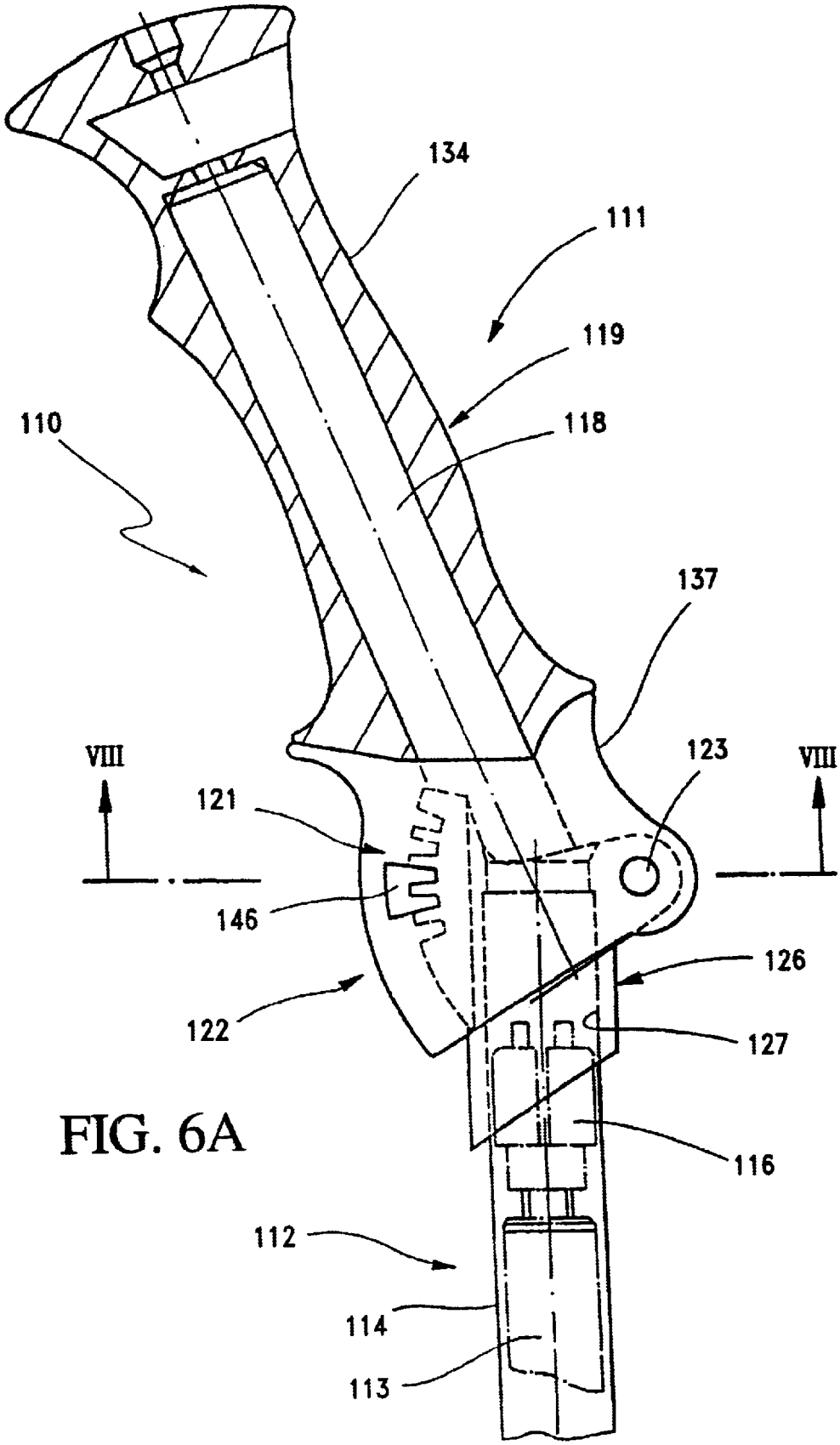
Figure 6B:
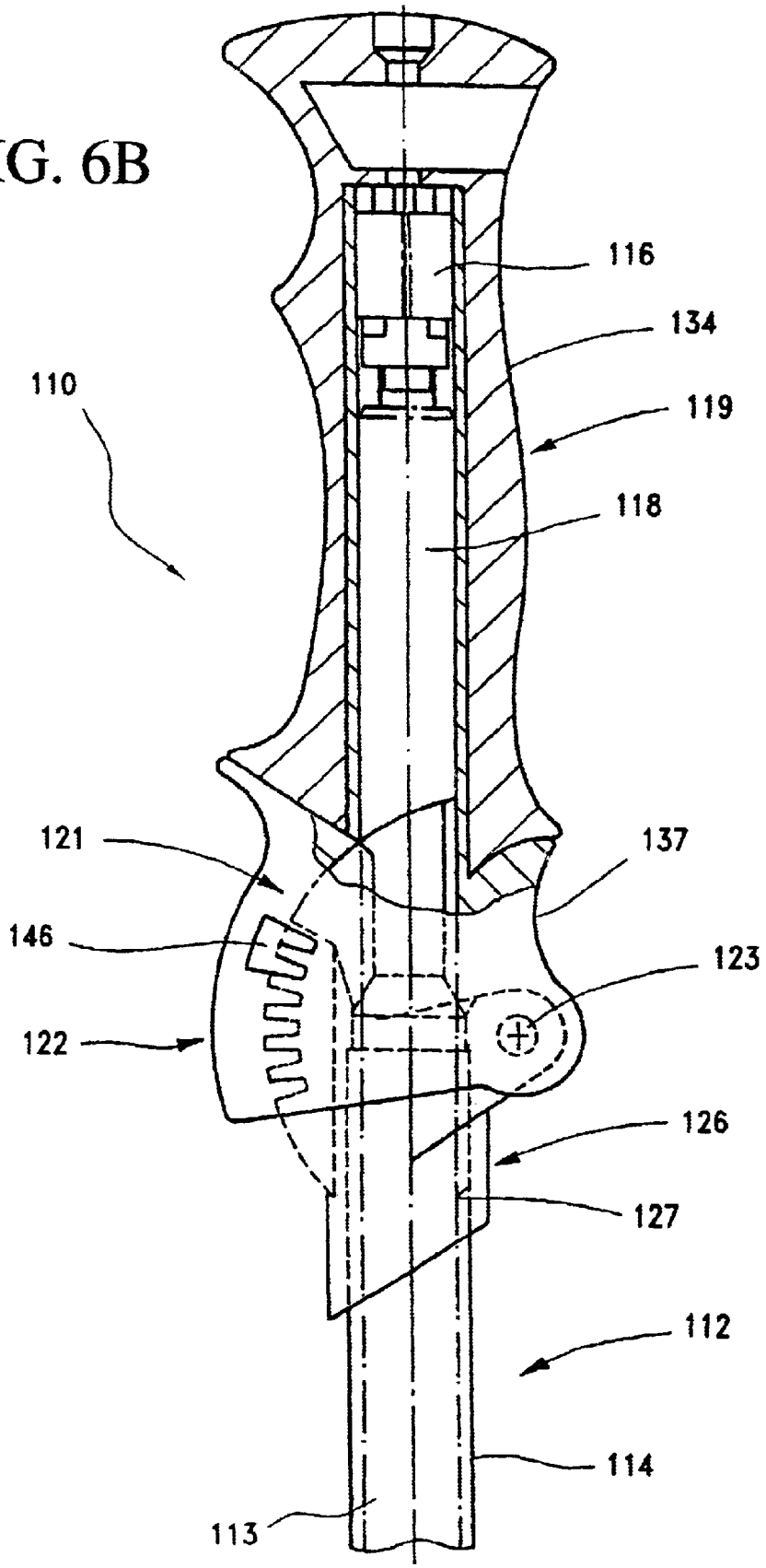

The stick handle 211, which is designed to fit the hand ergonomically, has on its lower end adjoining the handle element 219, which is approximately oval in cross section, an extension 237, which is formed on it in one piece and is also designed approximately oval in cross section with an enlarged longitudinal axis, as is shown in FIG. 4. The extension element 237 of the stick handle 211, which also constitutes a part of the adjusting device 222, has a cutout 238, in which the upper area of the cap 226 with the eye 228 and the section 231 in the shape of a universal ball joint are received. For this purpose the cutout 238 has a section on both sides of the blind bore 217 which corresponds to the shape of the eye 228, or of the section 231 in the shape of a universal ball joint. The section of the cutout 238 receiving the eye 228 of the cap 226 is delimited by two cheeks 241, arranged in the shape of a fork, which are provided with a bore 243. The two bores 243 receive a pivot shaft 244 of the pivot hinge 223, which penetrates the hollow shaft 254 of the clamping lever 253. In this case the pivot shaft 244, which is used for adjustment, is arranged eccentrically with respect to the bore 256 of the hollow shaft 254 of the pivot lever 253, wherein the outer diameter of the pivot shaft 244 is less than the inner diameter of the bore 256 of the clamping lever shaft 254. The lever bore 256 and the lever shaft 254 are eccentric with respect to each other, while the lever shaft 254 and the pivot shaft 244 are centered with respect to each other.

The section of the cutout 238 of the extension 237 located diagonally opposite the cheeks 241 is provided with an interior surface 239 in the shape of a universal ball joint, whose shape corresponds to the exterior surface 233 in the shape of a universal ball joint of the cap 226 and is, the same as the latter, provided with profiling, or ribbing 240, extending transversely to the pivot direction A. It is possible in this way to displace the two surfaces 233 and 239 in the shape of a universal ball joint in steps in accordance with the gaps between the ribbings 232 and 240 and can be fixed in place against each other.

Figure 14A:
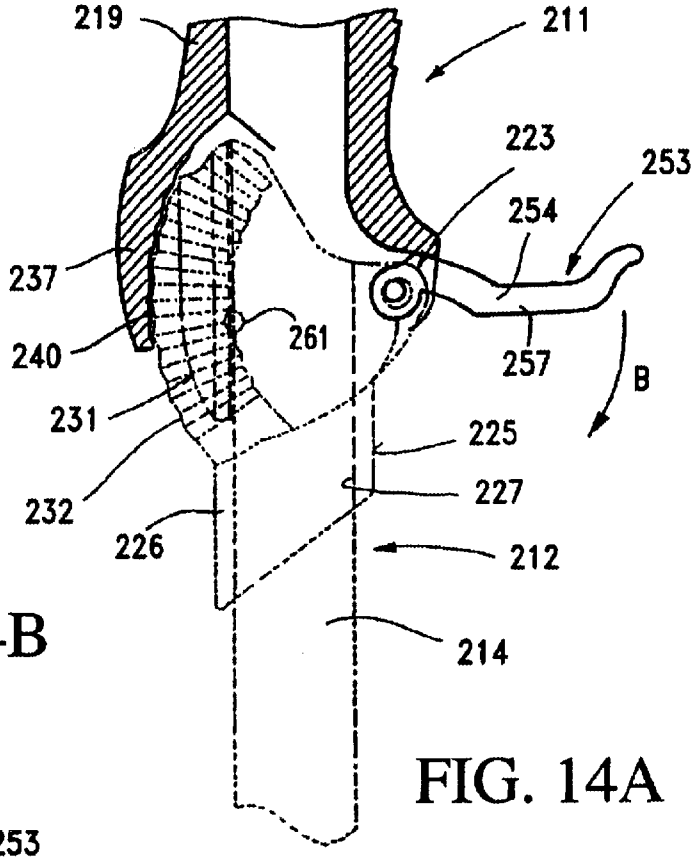
FIGS. 14A and 14B, show a representation corresponding to FIG. 7, but in a straight orientation of the stick in the released, or in the fixed, position of the adjusting device.
Figure 14B:
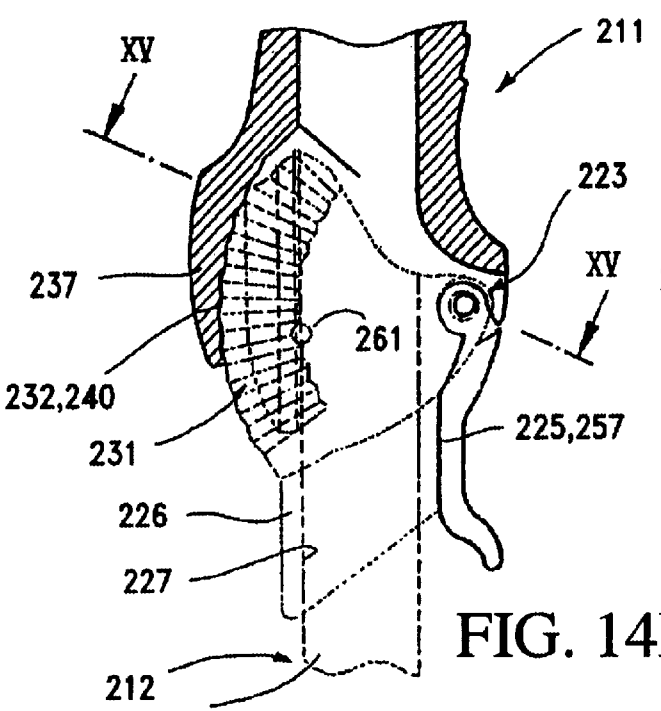
Figure 15:
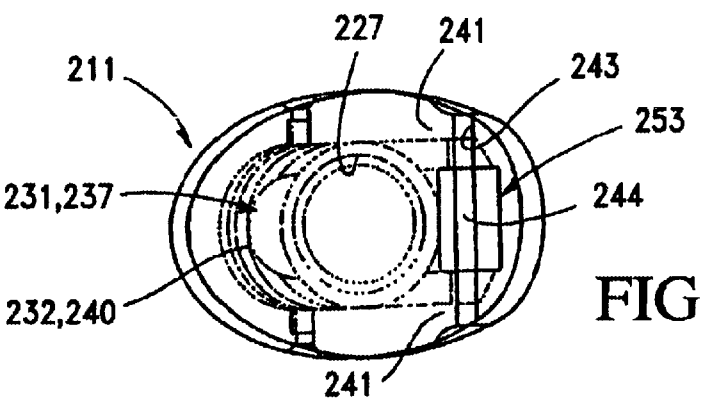
FIG. 15, is a section along the line XV—XV in FIG. 14B.

If in accordance with FIGS. 13 and 14A the clamping lever 253 is arranged in its upper, laterally projecting position, the exterior surface 233 in the shape of a universal ball joint and the interior surface 239 in the shape of a universal ball joint are then arranged, because of the eccentric arrangement of the clamping lever shaft 254 and the pivot shaft 244 at the handle area extension 237, at a radial distance in such a way that a pivot movement of the one surface in the shape of a universal ball joint with respect to the other surface in the shape of a universal ball joint, and therefore of the stick handle 211 with respect to the stick tube 212, becomes possible. If a defined angle position has been set, for example the one represented in FIG. 13, the clamping lever 252 is moved downward in the direction of the arrow B until it rests with its arm inside 257 against the outside 225 of the cap 226. Because of the eccentric seating, the pivot shaft 244 in accordance with FIGS. 14A and 14B is moved to the right during this movement, so that the interior surface 239 in the shape of a universal ball joint of the extension 237 moves toward the exterior surface 233 in the shape of a universal ball joint of the cap 226 and rests against it under pressure. An interlocked clamping of the set angle position is achieved in this way. It goes without saying that, instead of the interlocked clamped connection because of the ribbings 232 and 240, the surfaces in the shape of a universal ball joint can be embodied to be plain and can be individually, or both, covered with a friction coating, so that then a frictional connection results. An infinitely variable adjustment is possible with this embodiment, not represented.

In the area of its section 231 in the shape of a universal ball joint, the cap 226 of the stick tube 212 is provided with a marking 261, here in the shape of dots and, if desired, in color, which is a part of a marking device 260. The extension 237 of the stick handle 211 is provided with a window 262 of the marking device 260. This window 262 consists of a plurality of circular window elements 263 arranged on top of each other, which extend along a section of a circle whose center is the pivot shaft 244. During the adjusting movement the point marking 261 passes by the window elements 263. With the stepped adjustment possibility represented, the spacing of the window elements 263 has been selected in such a way that the point marking 261 appears in one of the window elements 263 for each adjustment step. It is possible in this way to set both sticks 210 of a pair of sticks at the same angle in a simple way. It goes without saying that the cross section of the marking 261 and of the window elements 263 can be selected in any arbitrary way. Although only five window elements 263, and therefore five steps, are represented in the example represented in FIG. 12, it goes without saying that these can also be more or fewer.

It furthermore goes without saying that the angled inclination of the stick handle 211 with respect to the stick tube 212 can also occur when the inner tube 213 has been pulled out of the blind bore 217 of the stick handle 211. In accordance with the exemplary embodiment represented, the non-angled position of the stick handle 211 with respect to the stick tube 212 is the one end position of the adjusting device 222, so that angling can take place in one direction exclusively.

In a further embodiment, the third exemplary embodiment can be combined with the second in regard to the two-piece embodiment of the handle element.

What is claimed is:

1. A stick, or the like, comprising:

a stick handle having a handle element;

a stick tube having a tube element;

a cap; and an adjusting device having a hinge arranged outside of said stick tube, by a means of which said handle element is fixed in place in an angled position with respect to said stick tube, wherein:

in the straight orientation of said stick tube, said tube element passes through said hinge into said handle element, said handle element forms, on a lower extension element thereof, an outer adjusting element of said adjusting device, said outer adjusting element defining a cutout;

said cap, which is fixedly connected with the upper end of said stick tube, forms an inner adjusting element of said adjusting device; and said inner adjusting element is pivotably received in the cutout of said outer adjusting element.

2. The stick as defined in claim 1, further comprising:

a pivot shaft;

a locking device, further wherein:

said inner and outer adjusting elements have said pivot shaft on one side of said stick tube, and said locking device on the opposite side of said stick tube, for fixation of the respective angled position.

3. The stick as defined in claim 2, further wherein:

said locking device has an outer tooth arrangement at said inner adjusting element and a locking slide on said outer adjusting element.

4. The stick as defined in claim 3, further wherein:

said locking slide projects past one side of said stick handle.

5. The stick as defined in claim 3, further wherein:

said locking slide has a longitudinal groove which receives a respective tooth of said outer tooth arrangement, and a notch which releases the tooth.

6. The stick as defined in claim 5, further comprising:

an eccentric lever, further wherein:

said longitudinal groove is conically embodied; and said eccentric lever cooperates with said locking slide.

7. The stick as defined in claim 1, further wherein:

in every angled position, said outer tooth arrangement is received inside of said cutout.

8. The stick as defined in claim 1, further comprising:

an eccentric lever, further wherein:

said eccentric lever operatively cooperates with said pivot hinges for clamping fixation in place of said two adjusting elements in a respective position.

9. The stick as defined in claim 8, further comprising:

a pivot shaft, and further wherein:

said pivot shaft is preferably maintained on said outer adjusting element, and said eccentric lever preferably on said inner adjusting element.

10. The stick as defined in claim 9, further wherein:

said eccentric lever has a bore; and said pivot shaft is seated in said bore, said bore having a greater diameter than said pivot shaft and is eccentric with respect to said eccentric lever.

11. The stick as defined in claim 8, further wherein:

said outer adjusting element has an interior surface in the shape of a universal ball joint, and said inner adjusting element has a corresponding exterior surface in the shape of a universal ball joint.

12. The stick as defined in claim 11, further wherein:

at least one of said interior surface and said exterior surface are provided with a friction coating.

13. The stick as defined in claim 11, further wherein:

at least one of said interior surface and said exterior surface are provided with profiling.

14. The stick as defined in claim 11, further comprising:

a device indicating the adjusted position, further wherein:

said adjusting device is provided with said device indicating the adjusted position.

15. The stick as defined in claim 14, further wherein:

said inner adjusting element has a marking, sand said outer adjusting element has a window.

16. The stick as defined in claim 15, further wherein:

said window comprises a plurality of window sections arranged along a ring section of a circle and whose shape corresponds to that of the marking.

17. The stick as defined in claim 1, further wherein:

said stick handle defines an axial blind bore which lengthens said stick tube.

18. The stick as defined in claim 1, further wherein:

said handle element includes the lower extension element.

19. The stick as defined in claim 1, further wherein:

said handle element is embodied in two pieces, by an upper partial handle element and a separate lower partial handle element; and said upper partial handle element is placed on said handle tube element and fastened.

20. The stick as defined in claim 1, further wherein:

said upper partial handle element is removable for exchange.

21. The stick as defined in claim 19, further wherein:

said upper partial handle element contains one of: all or parts of the handle area.

22. The stick as defined in claim 20, further wherein:

on its ends adjoining said lower partial handle element, said partial handle element is provided with a shape which makes a transition into the shape of the respective end of said lower partial handle element.

23. The stick as defined in claim 19, further wherein:

said lower partial handle element has a cutout, which partially receives the outer tooth arrangement of said adjusting element.

24. The stick as defined in claim 19, further wherein:

said handle tube element and said partial handle element are extruded as one piece.

* * * * *